US010677509B2

(12) United States Patent
Ogg

(10) Patent No.: US 10,677,509 B2
(45) **Date of Patent: *Jun. 9, 2020**

(54) REFRIGERATOR

(71) Applicant: LG Electronics Inc., Seoul (KR)

(72) Inventor: Anthony Ogg, Fort Lee, NJ (US)

(73) Assignee: LG Electronics Inc., Seoul (KR)

( * ) Notice: Subject to any disclaimer, the term of this patent is extended or adjusted under 35 U.S.C. 154(b) by 131 days.

This patent is subject to a terminal disclaimer.

(21) Appl. No.: 14/523,980

(22) Filed: Oct. 27, 2014

(65) Prior Publication Data

US 2015/0115790 A1 Apr. 30, 2015

(30) Foreign Application Priority Data

Oct. 28, 2013 (KR) ..... 10-2013-0128243

(51) Int. Cl.

| | |
|---|---|
| ***F25D 17/06*** | (2006.01) |
| ***F25D 11/02*** | (2006.01) |
| ***F25D 23/02*** | (2006.01) |
| ***F25D 25/02*** | (2006.01) |
| ***F25D 23/06*** | (2006.01) |

(52) U.S. Cl.

CPC ..... *F25D 23/021* (2013.01); *F25D 23/069* (2013.01); *F25D 25/025* (2013.01); *F25D 2317/062* (2013.01); *F25D 2317/0667* (2013.01)

(58) Field of Classification Search

CPC .... F25D 23/021; F25D 23/068; F25D 23/065; F25D 25/025; F25D 17/045; F25D 17/065

See application file for complete search history.

(56) References Cited

U.S. PATENT DOCUMENTS

| | | | | |
|---|---|---|---|---|
| 2,898,173 A * | 8/1959 | Squire | F25D 23/04 | 16/358 |
| 3,077,749 A * | 2/1963 | Jung | F25D 17/065 | 312/236 |
| 5,546,759 A * | 8/1996 | Lee | F25D 17/065 | 62/331 |
| 5,551,252 A * | 9/1996 | Lee | F25D 17/065 | 62/414 |
| 6,604,377 B2 * | 8/2003 | Watanabe | F25D 11/022 | 62/408 |

(Continued)

FOREIGN PATENT DOCUMENTS

| | | |
|---|---|---|
| JP | 2795970 | 9/1998 |
| KR | 1020060062147 | 6/2006 |
| KR | 20070069737 | 7/2007 |

*Primary Examiner* — Kimberley S Wright
(74) *Attorney, Agent, or Firm* — Fish & Richardson P.C.

(57) ABSTRACT

A refrigerator includes a cabinet defining a first storage compartment and a second storage compartment that is positioned vertically below the first storage compartment, a receiving drawer configured to be received into the second storage compartment, a mullion that partitions the first storage compartment from the second storage compartment, and an access cover configured to selectively open or close the access hole. The receiving drawer includes a receiving door configured to open and close the second storage compartment and a receiving box provided on a back surface of the receiving door. The mullion defines an access hole that allows fluid communication between the first and second storage compartments.

10 Claims, 14 Drawing Sheets

(56) References Cited

U.S. PATENT DOCUMENTS 6,629,429 B1 * 10/2003 Kawamura ..... F25D 17/065 62/441
6,742,353 B2 * 6/2004 Ohashi ..... F25D 17/04 62/405
6,880,949 B2 * 4/2005 Miozza ..... F25D 17/065 312/114
7,188,479 B2 * 3/2007 Anselmino ..... F25C 5/005 62/135
7,337,620 B2 * 3/2008 Coulter ..... F25D 11/02 62/137
7,475,562 B2 * 1/2009 Jackovin ..... F25C 5/005 312/404
8,960,825 B2 * 2/2015 Kwon ..... F25D 23/04 108/106
8,966,926 B2 * 3/2015 Eveland ..... F25C 5/005 362/92
9,228,776 B2 * 1/2016 Burke ..... F25D 23/065
9,429,351 B2 * 8/2016 Porter ..... F25D 17/045
9,739,524 B2 * 8/2017 Giacomini ..... F25D 23/069
9,759,479 B2 * 9/2017 Ramm ..... F25D 25/025
2005/0061016 A1 * 3/2005 Lee ..... F25C 1/04 62/340
2006/0016210 A1 * 1/2006 Lee ..... F25D 17/045 62/408
2006/0145577 A1 * 7/2006 Daley ..... A47B 96/021 312/408
2006/0266075 A1 * 11/2006 Itsuki ..... F25B 1/10 62/512
2007/0137242 A1 * 6/2007 Marques ..... F25D 17/062 62/407
2007/0163290 A1 * 7/2007 Shin ..... F25D 17/045 62/408
2009/0085453 A1 * 4/2009 Daley ..... A47B 96/021 312/408
2009/0277210 A1 * 11/2009 Eveland ..... F25C 5/005 62/441
2009/0308098 A1 * 12/2009 An ..... F25D 25/02 62/449
2010/0066227 A1 * 3/2010 Ramm ..... A47B 51/00 312/408
2012/0011879 A1 * 1/2012 Gu ..... F25D 17/065 62/408
2013/0043780 A1 * 2/2013 Ootsuka ..... F25D 25/025 312/402
2013/0127322 A1 * 5/2013 Seo ..... F25D 23/069 312/404
2013/0327083 A1 * 12/2013 Cho ..... F25D 11/00 62/407
2015/0059399 A1 * 3/2015 Hwang ..... F25D 25/025 62/441
2016/0334159 A1 * 11/2016 Hong ..... F25D 23/028

* cited by examiner

REFRIGERATOR

CROSS-REFERENCE TO RELATED APPLICATIONS

The present application claims priority under 35 U.S.C. 119 and 35 U.S.C. 365 to Korean Patent Application No. 10-2013-0128243 filed on Oct. 28, 2013, which is hereby incorporated by reference in its entirety.

FIELD

The present disclosure relates to a refrigerator.

BACKGROUND

Refrigerators are home appliances for storing foods at a low temperature. In recent years, demands for refrigerators with high capacity and low power consumption are increasing.

As such a refrigerator increases in capacity, a door of the refrigerator may also increase in size. Thus, a cool air loss occurring when the refrigerator door is opened, and therefore, power consumption may increase.

SUMMARY

Implementations provide a refrigerator that is capable of minimizing cool air losses and power consumption and improving user's convenience.

According to one aspect, a refrigerator includes a cabinet defining a first storage compartment and a second storage compartment that is positioned vertically below the first storage compartment, a receiving drawer configured to be received into the second storage compartment, a mullion that partitions the first storage compartment from the second storage compartment, and an access cover configured to selectively open or close the access hole. The receiving drawer includes a receiving door configured to open and close the second storage compartment and a receiving box provided on a back surface of the receiving door, and the mullion defines an access hole that allows fluid communication between the first and second storage compartments.

Implementations of this aspect may include one or more of the following features. For example, the access cover may be configured to slide forward or backward to open or close the access hole, respectively. The access cover may be configured to vertically rotate about a rear end thereof to open or close the access hole. The mullion may include a cover accommodation groove configured to receive the access cover when the access cover slidably moves in a backward direction. A top surface of the mullion may include a stepped portion configured to accommodate the access cover. The cabinet may further define a third storage compartment that is positioned vertically below the second storage compartment. The first and second storage compartments may be refrigerating compartments, and the third storage compartment may be a freezing compartment. The refrigerator according to this aspect may also include an additional mullion that partitions the second storage compartment from the third storage compartment. The access hole may be positioned closer to a front end of the mullion than a back end of the mullion. The refrigerator may further include at least one storage box placed on a top surface of the mullion. The at least one storage box may be positioned rearward of the access hole. At least a portion of the access cover may be transparent. A top surface of the mullion may include a stepped portion configured to accommodate the access cover.

According to another aspect, a refrigerator includes a cabinet defining a storage space, and a multi drawer assembly accommodated within the storage space and configured to slidably move forward or backward relative to the storage space. The multi drawer assembly includes a main drawer assembly configured to slidably move relative to the storage space and including a main door that is configured to selectively open or close a front opening of the storage space, and a sub drawer assembly provided within the main drawer assembly and configured to slidably move relative to the main drawer assembly. The sub drawer assembly includes a sub door that is configured to move forward or backward relative to the main door. The main door includes a sub door seat part that is recessed relative to a front surface of the main door to seat the sub door therein.

Implementations of this aspect may include one or more of the following features. For example, the main drawer assembly may include a main box coupled to a rear side of the main door, and a sub box accommodation part extending rearward from a back surface of the sub door seat part. The sub drawer assembly may further include a sub box coupled to a rear side of the sub door and configured to be accommodated within the sub box accommodation part. A handle may be disposed on each of the front surface of the main door below the sub door seat part and a front surface of the sub door. The refrigerator may further include a handle part disposed on a top surface of the sub door and recessed downward from a top surface of the sub door seat part, a door locking part disposed on the handle part and passing through the sub door to protrude rearward from a back surface of the sub door, and a hook groove that is recessed rearward from a front surface of the sub door part and configured to receive an end of the door locking part. The door locking part may include a grasp portion placed on the handle part, an arm extending rearward from the grasp portion to pass through the sub door, the arm being configured to rotate about a rotation shaft that is positioned along a length of the arm, and a hook end disposed on an end of the arm, the hook end being configured to be inserted into the hook groove. The refrigerator may further include a handle disposed on a front surface of the sub door. The refrigerator may further include an inner drawer assembly disposed on a rear side of the sub box accommodation part, the inner drawer assembly configured to slidably move forward or backward within the storage space. The inner drawer assembly may include an inner door and an inner box coupled to a rear side of the inner door. The inner door may be rotatably coupled to a front surface of the inner box. A cool air hole may be defined in at least one side of top and bottom surfaces, left and right surfaces, and a back surface of the sub box accommodation part. When the sub door is seated in the sub door seat part, a front surface of the sub door may be flush with the front surface of the main door. When the sub door is seated in the sub door seat part, both side surfaces of the sub door may be flush with both side surfaces of the main door, respectively. When the sub door is seated in the sub door seat part, a top surface of the sub door may be flush with a top surface of the main door.

The details of one or more implementations are set forth in the accompanying drawings and the description below. Other features will be apparent from the description and drawings, and from the claims.

DETAILED DESCRIPTION

Hereinafter, a refrigerator according to various implementations will be described in detail with reference to the accompanying drawings.

Figure 1:
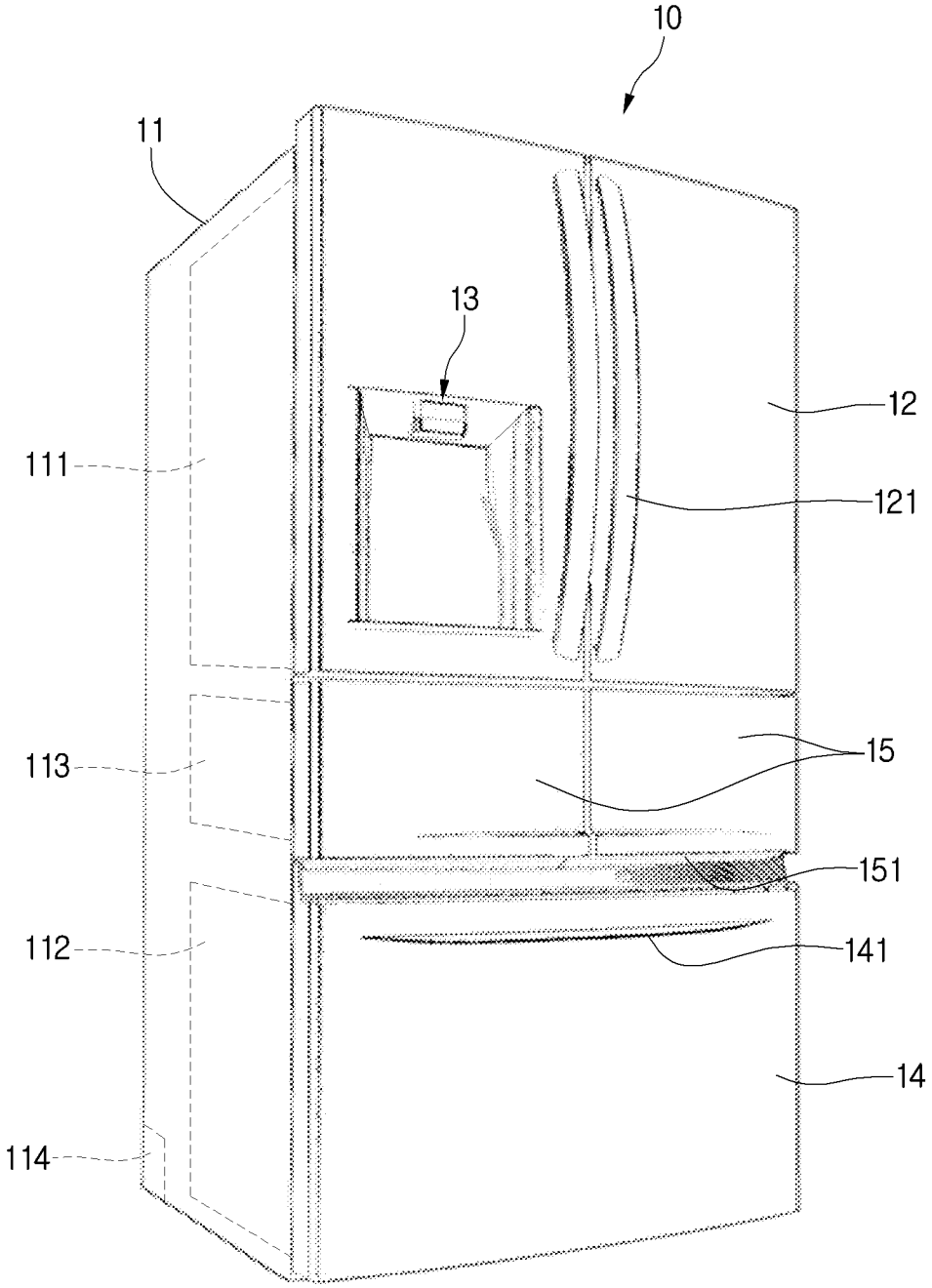
FIG. 1 is a perspective view illustrating an example refrigerator according to one implementation.
Figure 2:
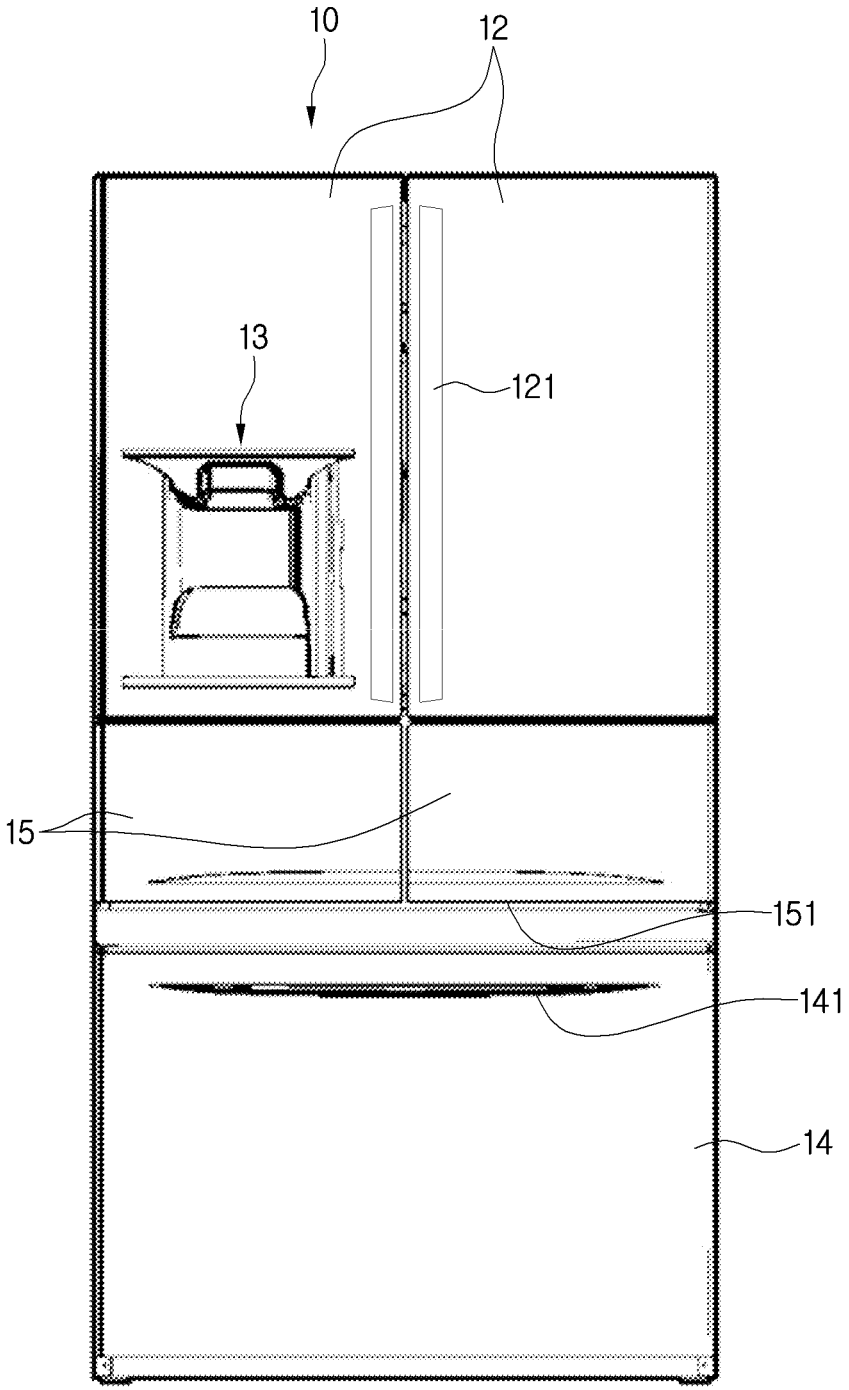
FIG. 2 is a front view of the refrigerator.
Figure 3:
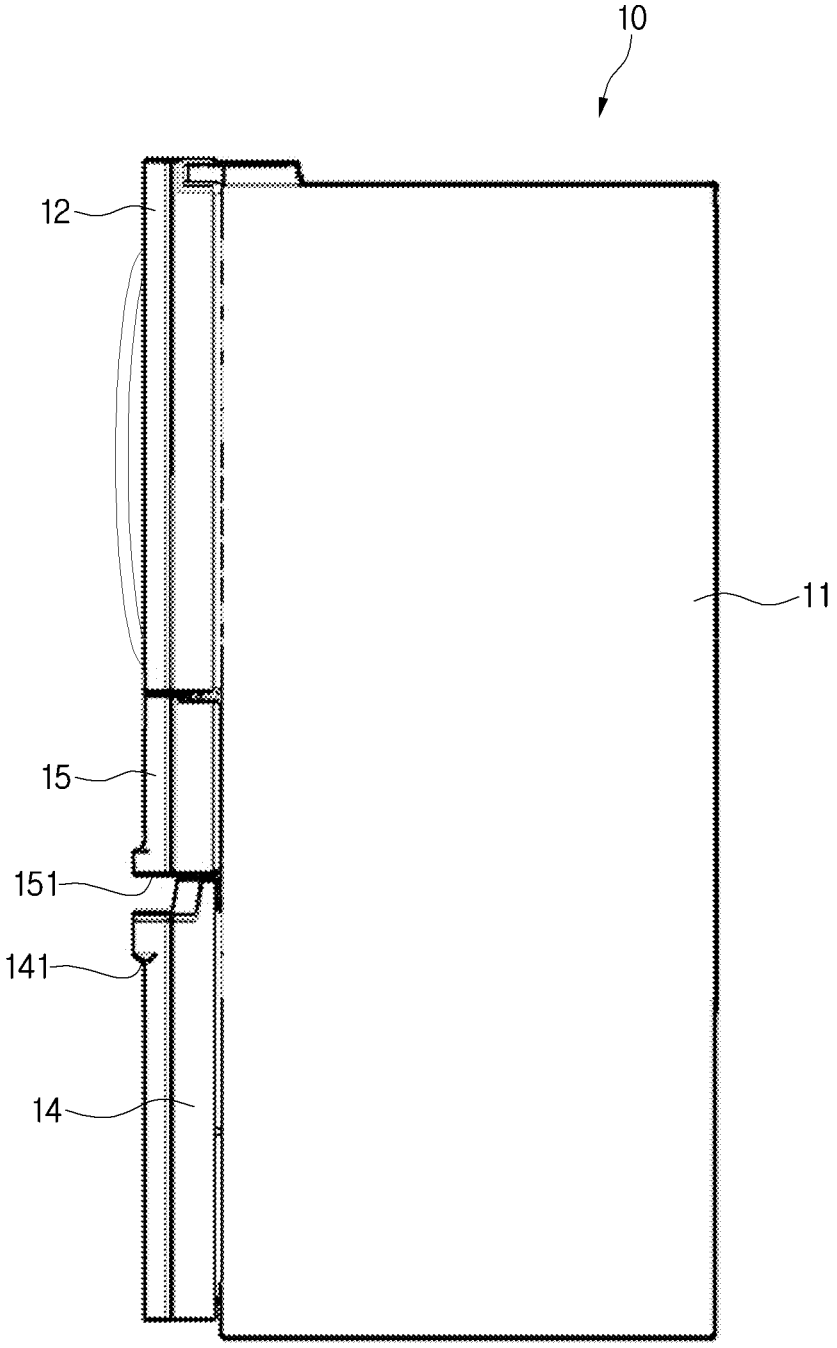
FIG. 3 is a side view of the refrigerator.

Referring to FIGS. 1 to 3, a refrigerator 10 according to one implementation includes a cabinet 11 defining an outer appearance thereof and having a storage compartment therein and a door disposed on a front surface of the cabinet 11 to open or close the storage compartment.

The storage compartment provided in the cabinet 11 includes a refrigerating compartment 111, freezing compartment 112, and a utility compartment 113. The utility compartment 113 may be a separate storage space according to an implementation of the present application. The refrigerating compartment 111 may function as a freezing compartment space, and the freezing compartment 112 may function as a refrigerating compartment space.

Also, the refrigerating compartment 111 may be defined in the uppermost side of the cabinet 11, the freezing compartment 112 may be defined in the lowermost side of the cabinet 11, and the utility compartment may be defined between the refrigerating compartment 111 and the freezing compartment 112. However, the current implementation is not limited to the above-described structure. For example, the refrigerating compartment 111 and the freezing compartment 112 may be defined parallel to each other at left and right sides of the cabinet 11. Here, the utility compartment 113 may be independently defined in a middle portion of the refrigerating compartment 111 or the freezing compartment 112 and be provided in a drawer type. That is, a separate storage space may be provided in addition to the refrigerating compartment 111 and the freezing compartment 112. In some cases, the separate storage space may communicate with the refrigerating compartment 111.

Here, the refrigerating compartment 111 may be defined as a first storage compartment, the utility compartment 113 may be defined as a second storage compartment, and the freezing compartment 112 may be defined as a third storage compartment.

A refrigerating compartment door 12 is disposed on a front surface of the refrigerating compartment 111, a freezing compartment door 14 is disposed on a front surface of the freezing compartment 112, and a utility compartment door 15 is disposed on a front surface of the utility compartment 113. Also, handles 121, 141, and 151 may be disposed on the front surfaces of the doors 12, 14, and 15, respectively.

In detail, as described above, the refrigerating compartment door 12 may be provided as a pair of rotatable doors, often referred to as a French door type. Each of the utility compartment door 15 and the freezing compartment door may be provided as the drawer type. In some cases, as described above, the utility compartment door 15 may be provided as at least two drawers. Alternatively, the utility compartment door 15 may be provided as a single drawer.

Also, a dispenser 13 for dispensing ice or water may be disposed in one of the pair of rotatable doors constituting the refrigerating compartment door 12. Also, an ice making device may be disposed on a back surface of the door in which the dispenser 13 is provided or inside the refrigerating compartment 111. A space 114 represents a machine room in which refrigerating cycle components such as a compressor and a condenser can be stored.

Figure 4:
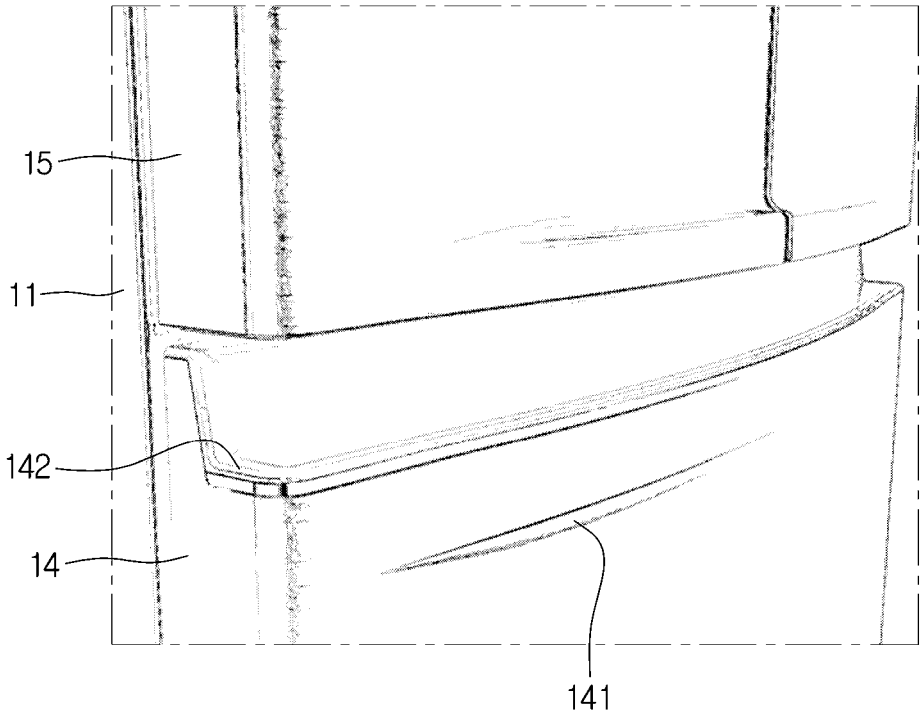
FIGS. 4 and 5 are enlarged perspective views illustrating structures of handles of a utility compartment door and freezing compartment door of the refrigerator.
Figure 5:
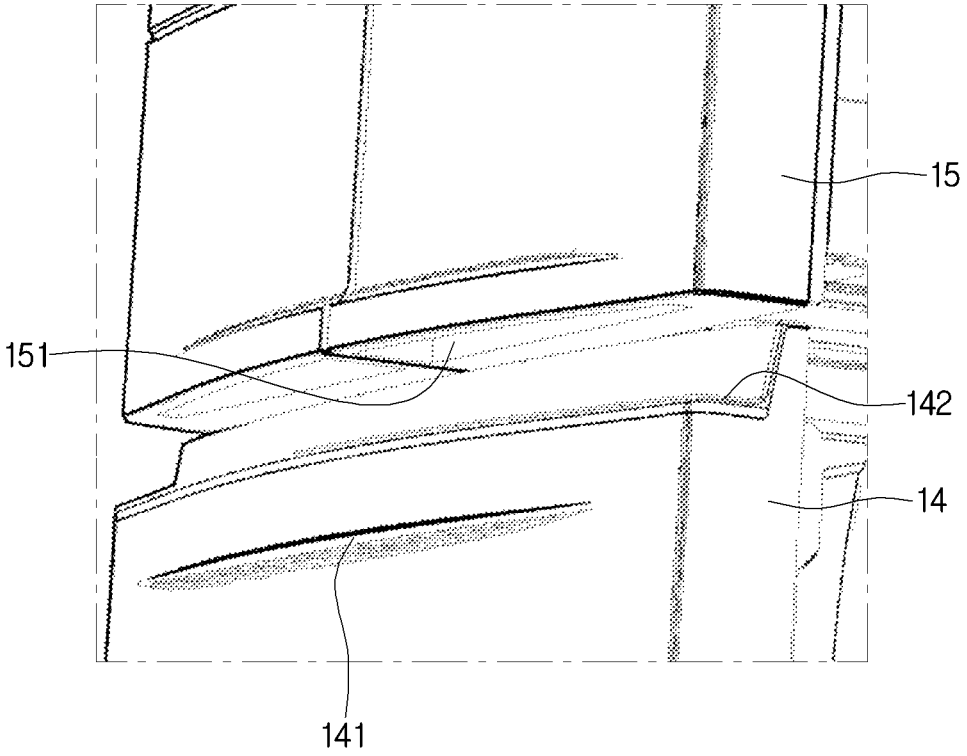

FIGS. 4 and 5 illustrate structures of the handles of the utility compartment door and freezing compartment door of the refrigerator according to an implementation.

Referring to FIGS. 4 and 5, the bar-shaped handle 121 protruding to the outside may be disposed on a front surface of the refrigerating compartment door 12. Also, the recessed handles 151 and 141 may be disposed in the utility compartment door 15 and the freezing compartment door 14, respectively.

In detail, as shown in FIGS. 4 and 5, the handle 151 of the utility compartment door 15 may be provided in a shape that is recessed upward by a predetermined depth from a bottom surface of the utility compartment door 15. Also, the handle 141 of the freezing compartment door 14 may be provided in a shape that is recessed upward by a predetermined depth from a front surface of the freezing compartment door 14.

A stepped portion 142 that is stepped at a predetermined height may be disposed on an upper end of the freezing compartment door 14. The stepped portion 142 may be provided to generate a gap having a predetermined distance between a top surface of the freezing compartment door 14 and the bottom surface of the utility compartment door 15. Thus, when the user's hand is inserted into the handle 151 of the utility compartment door 15, the user's hand may not interfere with the top surface of the freezing compartment door 14 to improve convenience of use. Alternatively, a handle recessed by a predetermined depth may be disposed on a stepped surface of the stepped portion 142. If the handle 141 of the freezing compartment door 14 is not provided on the front surface of the freezing compartment door 14, but is provided on the stepped surface of the stepped portion 142, the front surface of the freezing compartment door 14 may be cleanly treated when viewed from a front side of the refrigerator.

Figure 6:
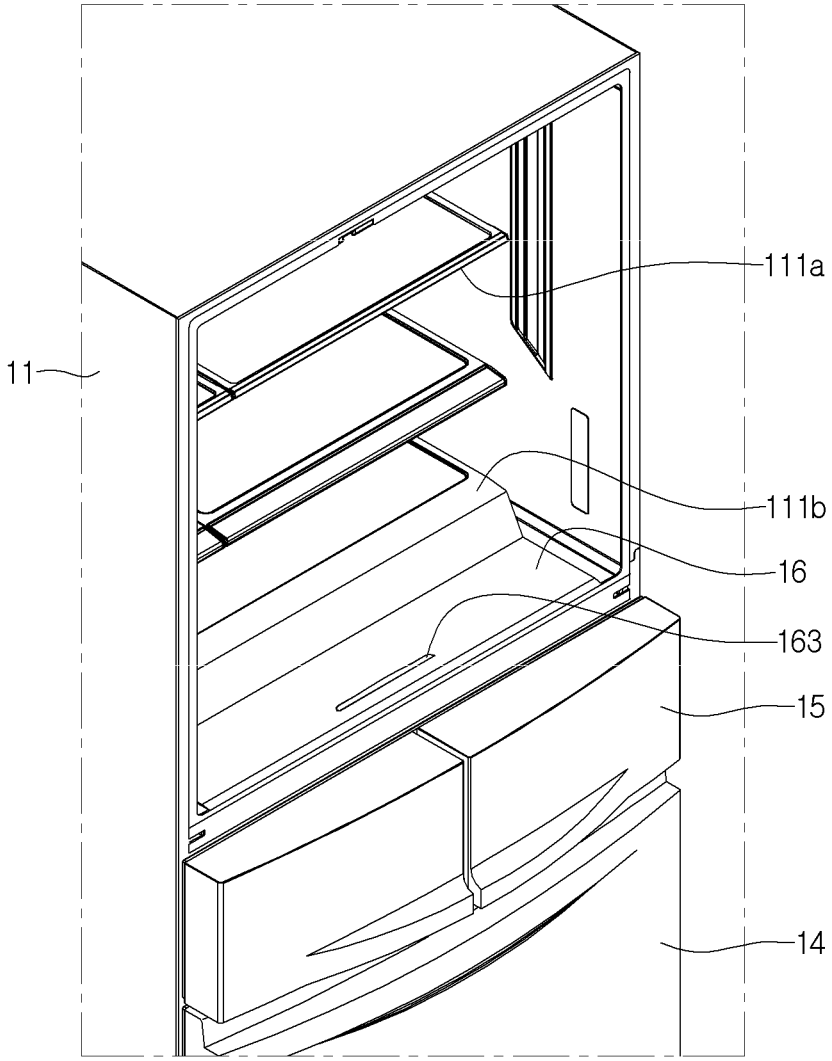
FIG. 6 is a perspective view illustrating an inner structure of a refrigerator cabinet including an access cover.
Figure 7:
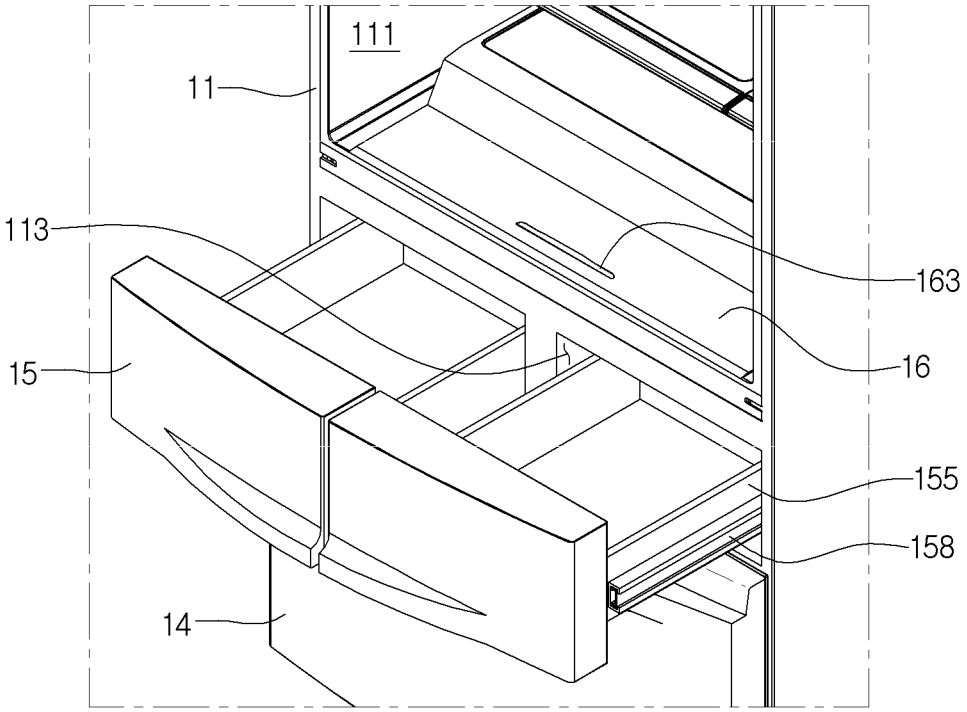
FIG. 7 is a perspective view illustrating a structure of a receiving drawer received into the utility compartment.
Figure 8:
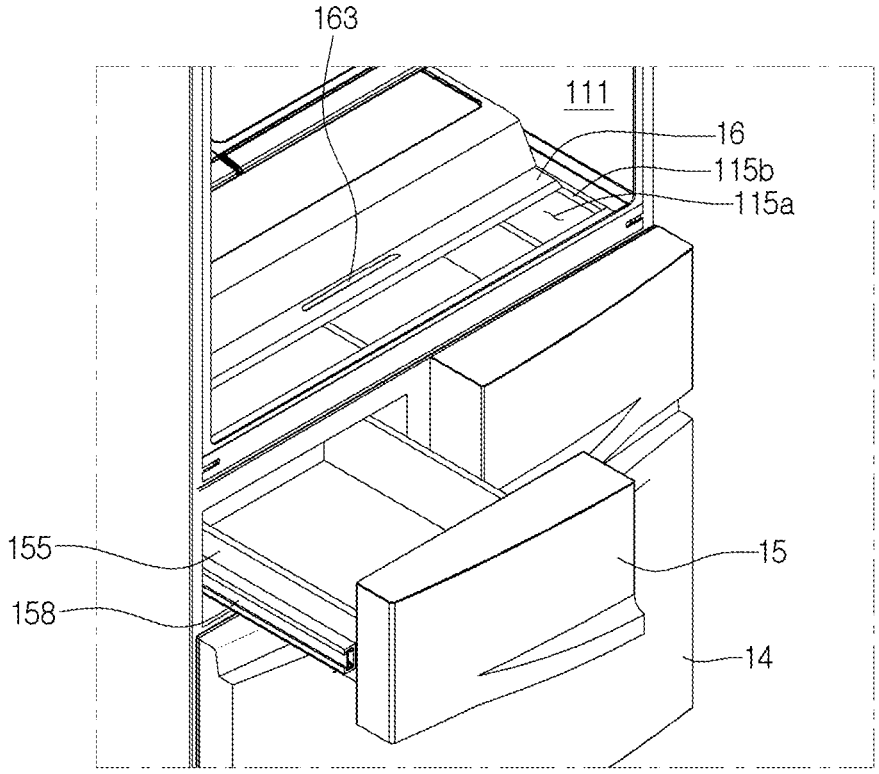
FIG. 8 is a perspective view illustrating a state in which the receiving drawer and the access cover are opened.

FIG. 6 illustrates an inner structure of the refrigerator cabinet including an access cover according to an implementation, FIG. 7 illustrates a structure of a receiving drawer received into the utility compartment according to an implementation, and FIG. 8 illustrates a state in which the receiving drawer and the access cover are opened.

Referring to FIGS. 6 to 8, a receiving drawer received into the utility compartment 113 according to an implementation includes a receiving door 15, a receiving box 155 disposed on a back surface of the receiving door 15, and slide rails 158 disposed on both side surfaces of the receiving box 155. Rail guides are disposed on both side surfaces of the inside of the utility compartment 113. The to the slide rails 158 may be movably coupled to rail guides to allow the receiving drawer to slidably move forward or backward. Hereinafter, the utility compartment door will be defined as a receiving door 15.

One or more shelves 111*a* may be disposed inside the refrigerating compartment 111 so that foods or containers can be placed on the shelves 111*a*. In addition, one or more storage boxes 111*b* may be disposed inside refrigerating compartment 111 to accommodate foods.

The refrigerating compartment 111 and the utility compartment 113 are vertically partitioned by a first mullion 115, and an access hole 115*a* is defined in a front side of the first mullion 115. Also, the access hole 115*a* may be selectively opened or closed by an access cover 16.

In detail, the access hole 115*a* may extend by a length corresponding to a width of the first mullion 115 and have a predetermined width toward a rear side of the refrigerating compartment 111. Also, the access hole 115*a* may have a length extending in left and right directions, which is equal to or less than a horizontal length of a refrigerating space of the receiving box 155. Also, the storage box 111*b* disposed on a top surface of the first mullion 115 may be disposed on a rear side of the access hole 115*a* to prevent the storage box 111*b* from interfering with the access hole 115*a*.

Also, the access cover 16 may be formed of a transparent material to allow the user to confirm contents accommodated in the receiving box 155. Here, when the access cover 16 closes the access hole 115*a*, the receiving box 155 may be maintained at the same or substantially the same temperature as that of the refrigerating compartment 111 by thermal conduction through the access cover 16. When the access cover moves backward to open the access hole 115*a*, cool air within the refrigerating compartment 111 may be transferred into the receiving box 155 by convection.

The access cover 16 may be formed of a transparent glass material or plastic plate. Also, a frame for reinforcing may be surrounded around an edge portion of the access cover 16, or an opaque film may be attached to the edge portion of the access cover 16. A handle 163 may be disposed on a top surface of a front end of the access cover 16. The handle 163 may be provided in a rib shape protruding upwardly or a recessed shape received at a predetermined depth.

Also, a sliding groove 115*b* may be defined in an edge of each of both side surfaces of the access hole 115*a*. Thus, since the edges of both side surfaces of the access cover 16 are respectively inserted into the sliding grooves 115*b*, the access cover 16 may be slid forward or backward to selectively open or close the access hole 115*a*. Also, a cover accommodation groove may be defined in the first mullion 115 to accommodate the access cover 16 that is slid to move in the rear direction. In some cases, the top surface of the first mullion 115 may be stepped by a height corresponding to a thickness of the access cover 16 so that a gap in which the access cover 16 is accommodated is defined between the top surface of the first mullion 115 and the bottom surface of the storage box 111*b* (see FIG. 9). When the access cover 16 is slid backward, a top surface of the access cover 16 may be flush with the top surface of the first mullion 115.

Alternatively, the access cover 16 may be rotatably coupled to the first mullion 115. That is, a rear end of the access cover 16 may be rotatably coupled to the first mullion 115, i.e., the rear edge portion of the access hole 115*a*. Thus, the user may hold and lift the handle 163 of the access cover 16 to take foods in or out of the receiving box 155.

Figure 9:
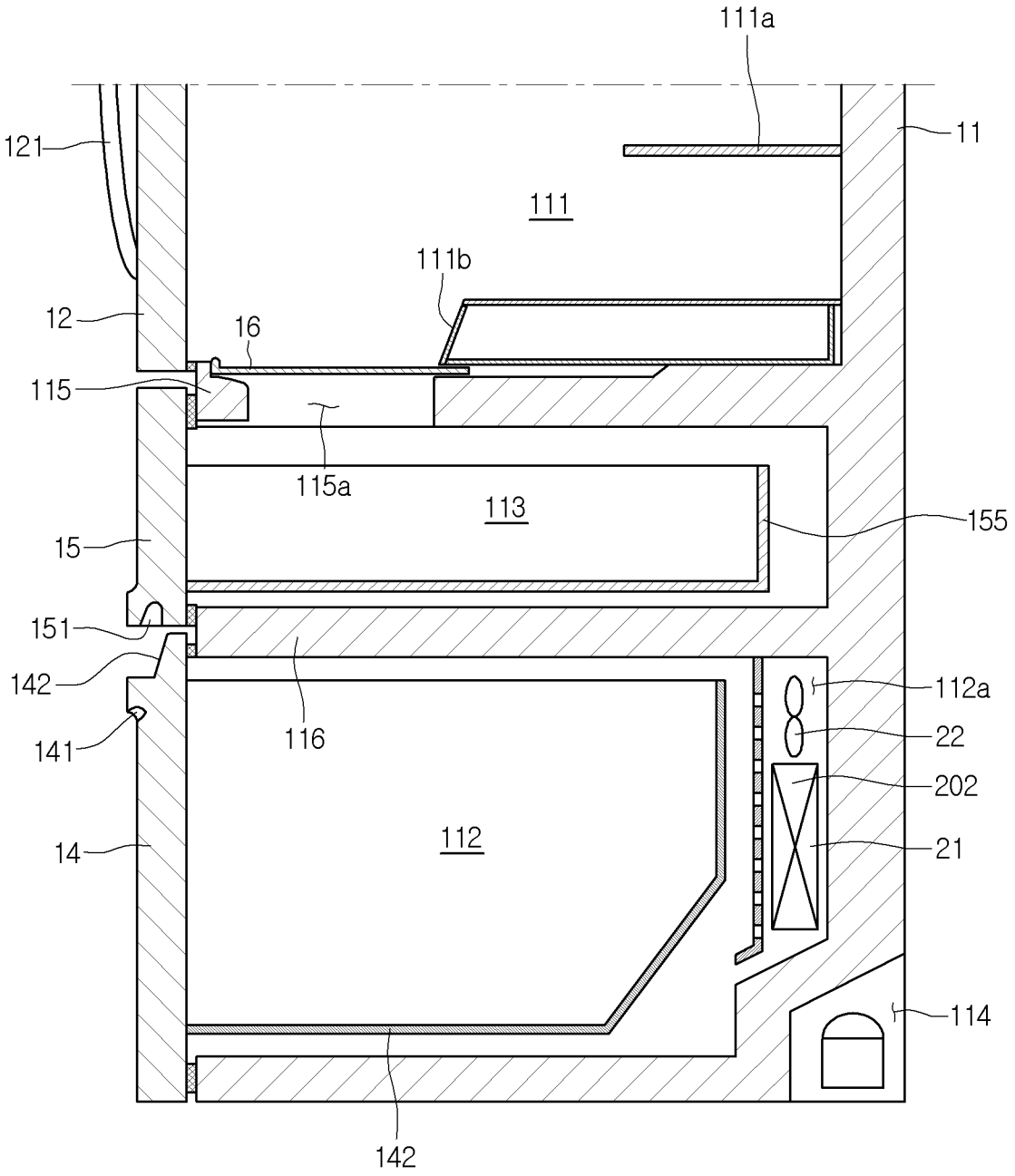
FIG. 9 is a longitudinal sectional view of the refrigerator.

Referring to FIG. 9, when the receiving door 15 is completely closely attached to the front surface of the cabinet 11, the access hole 115*a* defined in the first mullion 115 may be disposed above the receiving box 155. Also, the access hole 115*a* may be closed by the access cover 16, or the access cover 16 may move backward to open the access hole 115*a*. When the access hole 115*a* is closed by the access cover 16, the cool air within the refrigerating compartment 111 may be transferred into the receiving box 155 by the thermal conduction. On the other hand, when the access hole 115*a* is opened, the cool air within the refrigerating compartment 111 may be directly transferred into the receiving box 155.

A freezing compartment drawer may be mounted on a back surface of the freezing compartment door 14. As described above, the freezing compartment 112 may have a structure for accommodating a receiving member having a drawer shape, like the utility compartment 113. Also, a cool air grill 202 may be disposed in a rear side of the freezing compartment 112, and an evaporation chamber 112*a* may be defined in a rear space of the cool air grill 202. Also, an evaporator 21 and a cooling fan 22 may be disposed in the evaporation chamber 112*a*.

Figure 10:
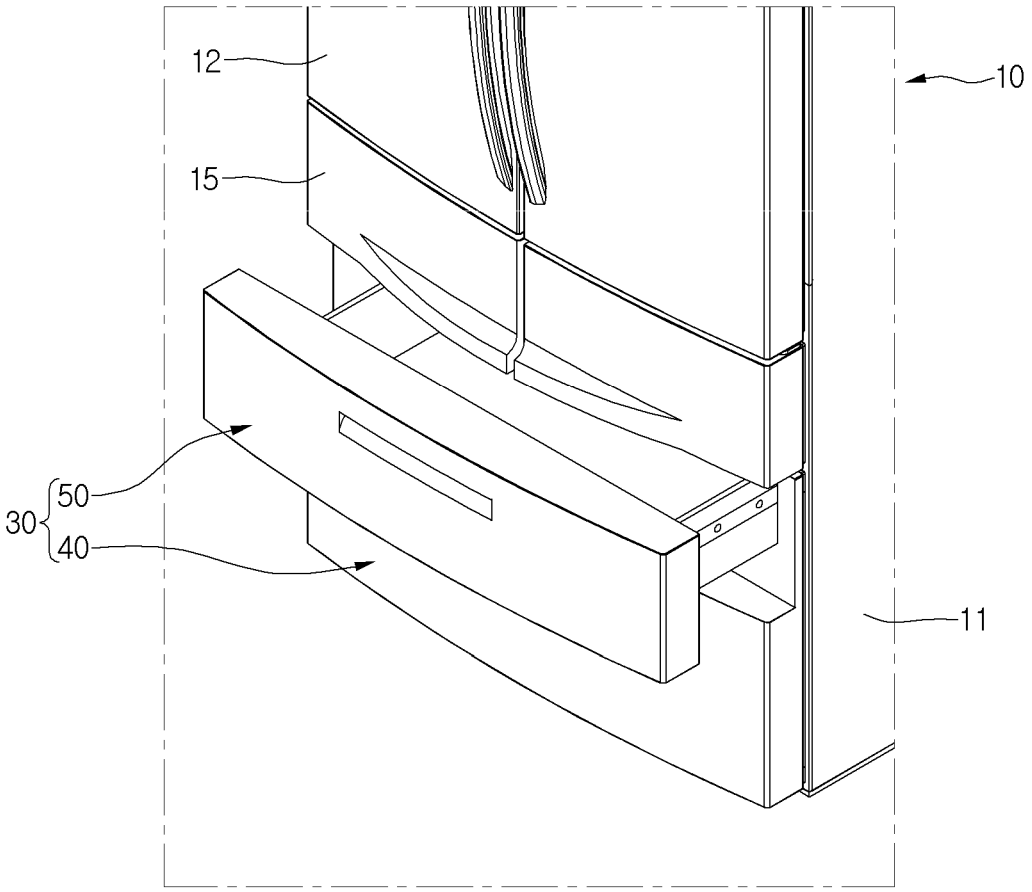
FIG. 10 is a perspective view of an example refrigerator including a multi drawer assembly according to another implementation.
Figure 11:
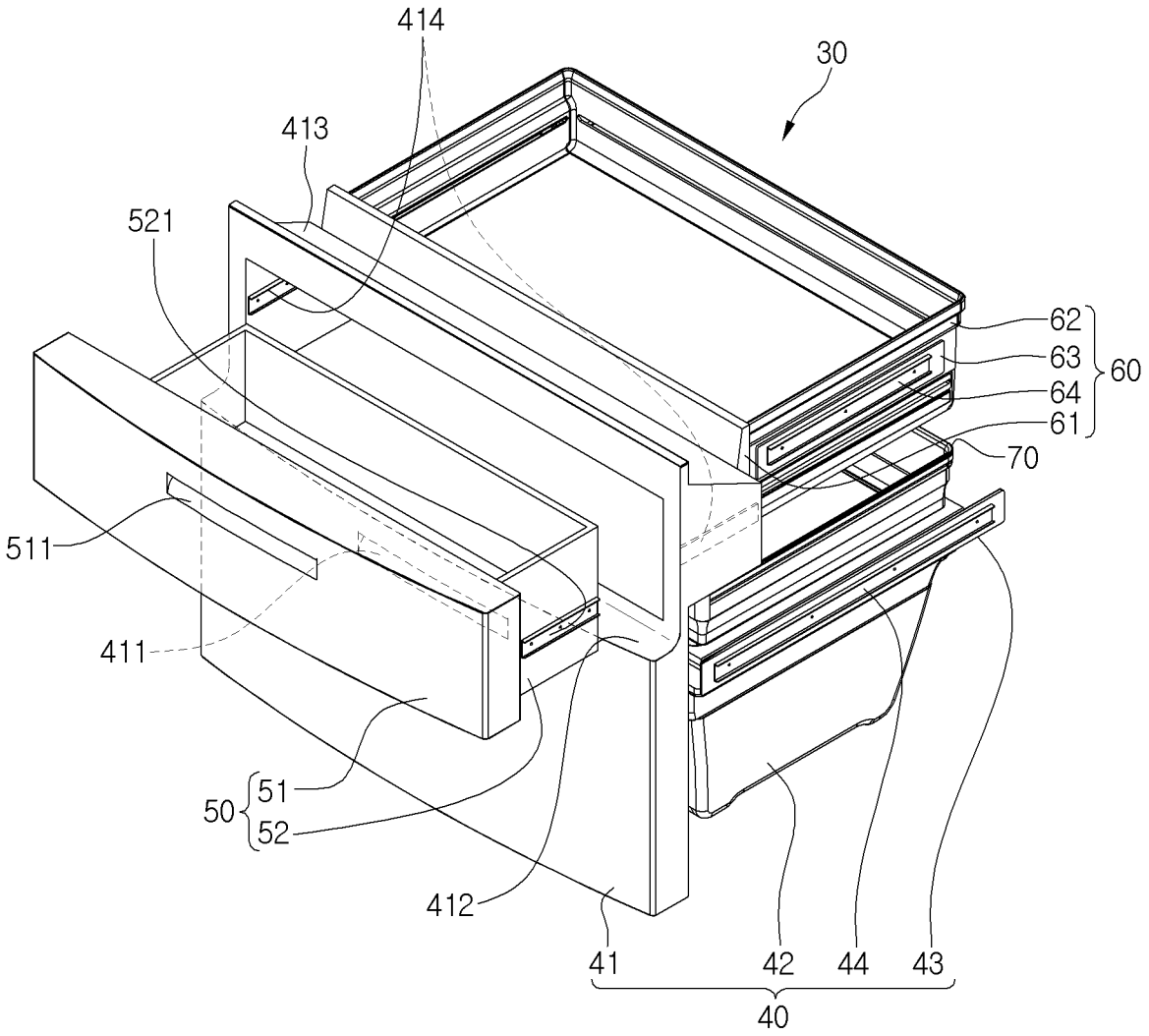
FIG. 11 is an exploded perspective view of the multi drawer assembly of FIG. 10.
Figure 12:
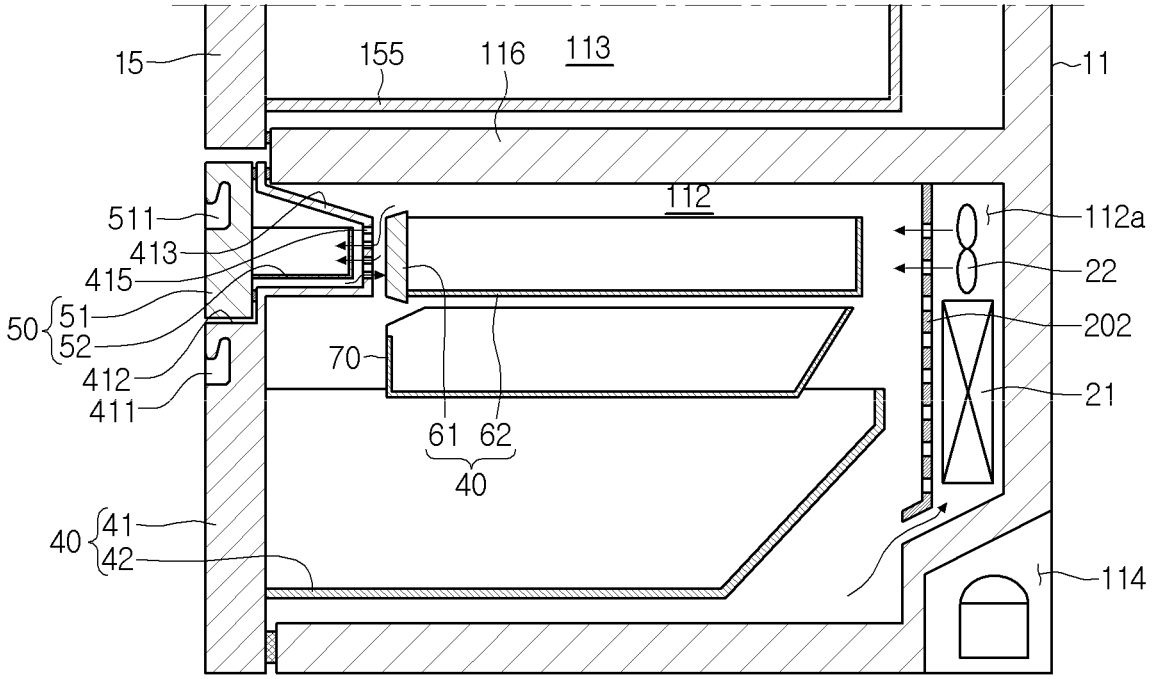
FIG. 12 is a longitudinal sectional view of the refrigerator including the multi drawer assembly of FIG. 10.

FIG. 10 illustrates a refrigerator with a multi drawer assembly according to an implementation, and FIGS. 11 and 12 illustrate the multi drawer assembly.

Referring to FIGS. 10 to 12, the refrigerator 10 according to this implementation includes a multi drawer assembly 30 including another door and a receiving structure within the door.

In detail, the multi drawer assembly 30 includes a main drawer assembly 40 and a sub drawer assembly 50 independently provided inside the main drawer assembly 40. In the drawings, although the multi drawer assembly 30 is accommodated in the freezing compartment 112, a storage space for accommodating the multi drawer assembly 30 may be the refrigerating compartment.

Also, an inner drawer assembly 60 may be separately provided on a rear side of the sub drawer assembly 50. The inner drawer assembly 60 may be independently slid and withdrawn in a state where the main drawer assembly 40 is withdrawn from the storage space.

The main drawer assembly 40 includes a main door 41 for opening or closing a front opening of the storage space, a door frame 43 extending from a back surface of the main door 41, and a main box 42 separably seated on the door frame 43. Also, a middle box 70 may be further provided above the main box 42. The middle box 70 may move together with the main box 42 when the main door 41 moves. Also, the middle box 70 may independently slidably move forward or backward above the main box 42. Also, the middle box 70 may be slid along a top surface of the door frame 43 or a top surface of the main box 42. Also, the middle box 70 may be separable from the main box or the door frame 43. A sub door seat part 412 that is recessed or stepped at a predetermined depth may be provided in an upper portion of the front surface of the main door 41. Also, a sub box accommodation part 413 may protrude from a back surface of the main door 41 corresponding to that of the sub door seat part 412. Also, a space for accommodating the sub box may be defined inside the sub box accommodation part 413. A cool air hole (see reference numeral 415 of FIG. 12) through cool air is introduced or discharged is defined in a back surface of the sub box accommodation part 413. The cool air hole 415 may be defined in at least one surface of the back surface, top and bottom surfaces, and both side surfaces of the sub box accommodation part 413.

A handle 411 may be disposed on the front surface of the main door 41. The handle 411 may be provided in a space that is recessed by a predetermined depth from the front surface of the main door 41 or in a shape in which a separate handle bar is attached to the front surface of the main door 41.

In some cases, the sub drawer assembly 50 may include a sub door 51 seated on the sub door seat part 412 and a sub box 52 disposed on a back surface of the sub door 51. A slide rail 521 extends from each of both side surfaces of the sub box 52, and a rail guide 414 coupled to the slide rail 521 is disposed on each of inner side surfaces of the sub box accommodation part 413. Thus, the sub drawer assembly 50 may move forward or backward as the slide rail 521 moves forward or backward along the rail guide 414. Here, although the slide rail 521 is directly attached to the side surface of the sub box 52, a door frame may protrude from the back surface of the sub door 51, and then the slide rail 521 may be mounted on the door frame, like the main box 42. Also, the sub box 52 may be separably mounted on the door frame.

In some cases, a handle having the same shape as that of the handle provided on the main door 41 may be provided on the front surface of the sub door 51. Also, in the state where the sub door 51 is completely closely attached to the sub door seat part 412, the front surface of the sub door 51 may flush with that of the main door 41.

The inner drawer assembly 60 may be disposed on a rear side of the sub box accommodation part 413.

In detail, the inner drawer assembly 60 includes an inner door 61 on which a handle is disposed on a front surface thereof and an inner box 62 mounted on a back surface of the inner door 61. Also, a slide rail 64 may be mounted on each of both side surfaces of the inner box 62, and a guide rail may be disposed on each of both side surfaces of the storage space corresponding to each of both side surfaces of the inner box 62. The slide rail 64 may be directly disposed on each of both side surfaces of the inner box 62. Alternatively, a door frame 63 may extend from the back surface of the inner door 61, and then the slide rail 64 may be disposed on the door frame 63.

Also, in a state where the inner door 61 is inserted into the storage space, the front surface of the inner door 61 may be spaced a predetermined distance from the back surface of the sub box accommodation part 413 in the state where the main door 41 is completely closed. Thus, when the main door 41 is closed, the back surface of the sub box accommodation part 413 may not interfere with the front surface of the inner door 61 to smoothly guide cool air into the cool air hole 415 defined in the back surface of the sub box accommodation part 413.

As shown in FIG. 8, the multi drawer assembly 30 may be accommodated into the freezing compartment 112. The freezing compartment 112 and the utility compartment 113 may be partitioned by a second mullion 116.

Also, the inner drawer assembly 60 may be disposed in an upper side of the freezing compartment 112, i.e., a direct lower side of the second mullion 116. Since a distance between a bottom surface of the second mullion 116 and a top surface of the inner drawer assembly 60 is narrowed, a rear region of the inner door 61 may not get out of a front end of the second mullion 116 even though the inner door 61 is fully withdrawn. As a result, it may be inconvenient to take foods out of the inner box 62. In view of the above-described scenario, the inner door 61 may be rotatable forward by using a lower end of the inner door 61 as a rotation center. The inner door 61 may be fully rotated until the inner door 61 reaches a horizontal state to open the front surface of the inner box 62. For this, the door frame 63 may be coupled to both ends of the back surface of the inner door 61, and the lower end of the inner door 61 may be rotatably connected to the door frame 63. Alternatively, a lower end of the back surface of the inner door 61 may be rotatably connected to an edge portion of the front surface of the inner box 62. A coupling member such as a latch hook may protrude from the back surface of the inner door 61, and a latch groove to which the latch hook is hooked may be defined in the edge portion of the front surface of the door frame 63. Also, a locking unit for operating the latch hook may be disposed on the handle provided on the front surface of the inner box 62. The latch hook and the locking unit may adopt a door locking structure of the sub drawer assembly that will be described below.

Figure 13:
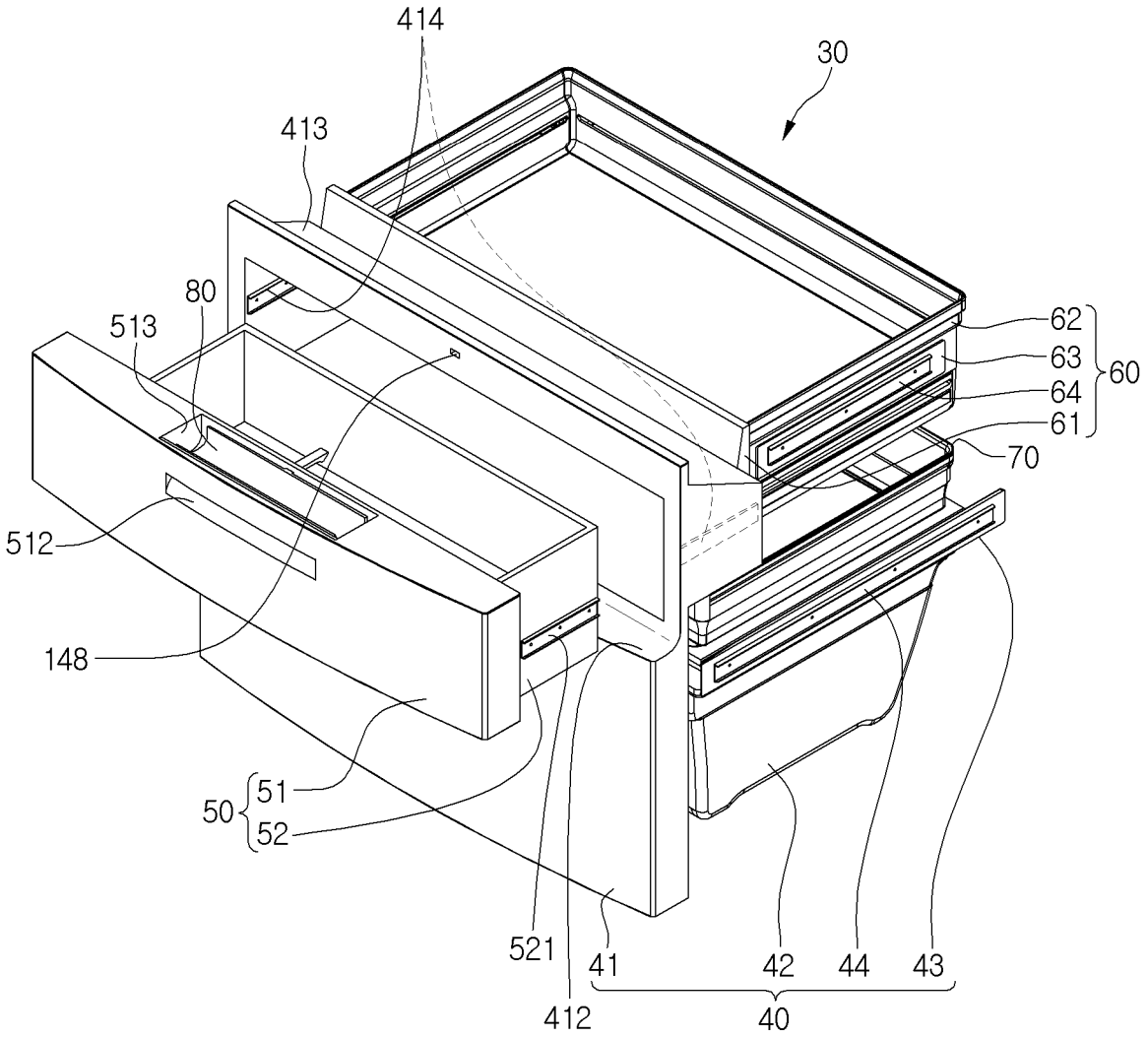
FIG. 13 is a perspective view of a multi drawer assembly according to yet another implementation.
Figure 14:
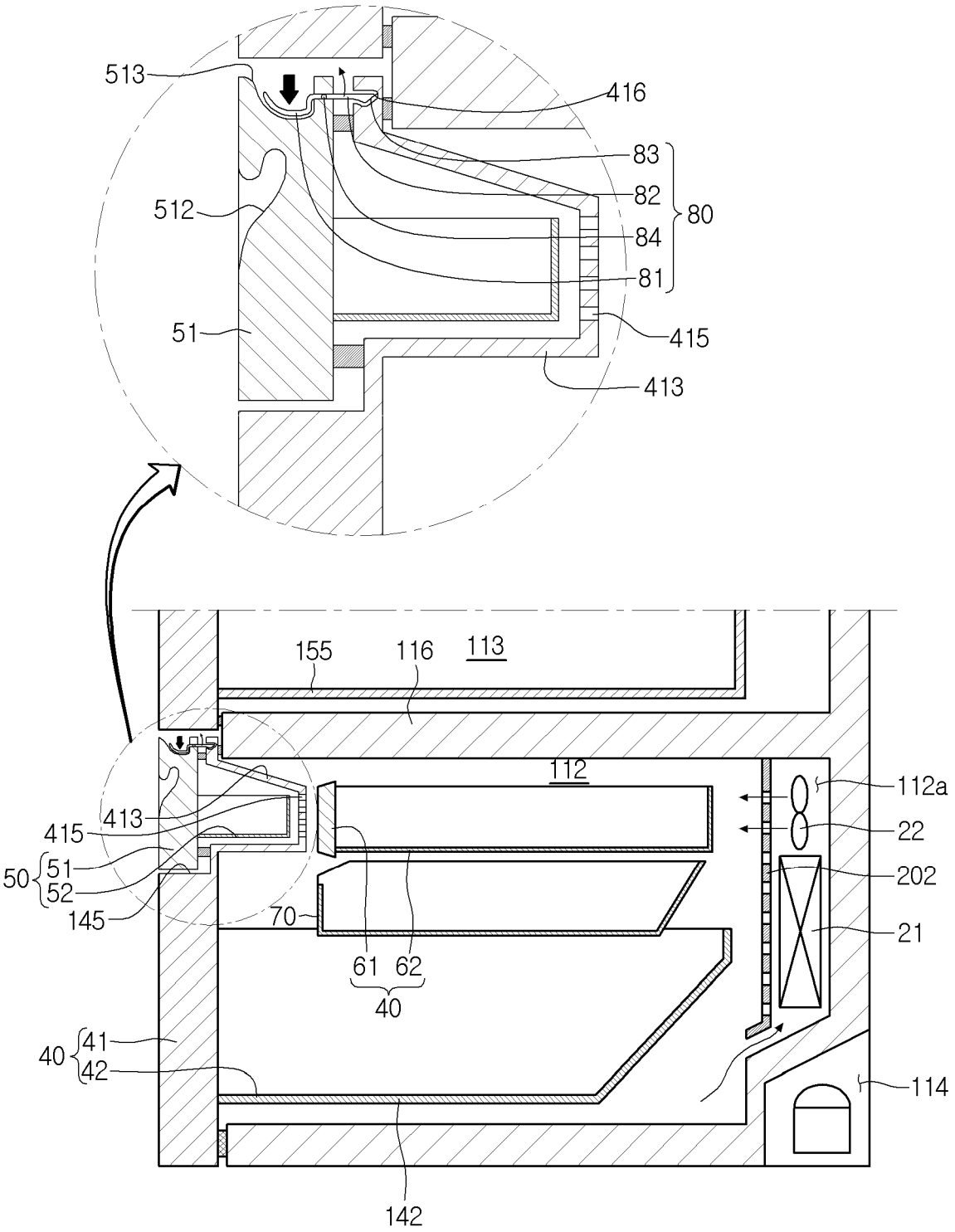
FIG. 14 is a longitudinal sectional view of a refrigerator including the multi drawer assembly of FIG. 13.

FIG. 13 illustrates a multi drawer assembly according to another implementation, and FIG. 14 illustrates a refrigerator including the multi drawer assembly.

A multi drawer assembly 30 according to this implementation may have the same structure as the above-described multi drawer assembly 30 except for a door locking structure for selectively opening the main door 41 and the sub door 51. Thus, descriptions with respect to the same structure as that described in the foregoing implementations will be omitted.

In detail, in the foregoing implementation, the handles 411 and 511 are respectively provided on the main door 41 and the sub door 51 to independently open or close the main door 41 and the sub door 51. However, in the current implementation, a handle structure for opening or closing the main door 41 may be disposed on the sub door 51.

Referring to FIGS. 13 and 14, a first handle 512 may be disposed on a front surface of the sub door 51, and a second handle 513 may be disposed on a top surface of the sub door 51. Also, the first handle 512 may be used for opening only the main door 41, and the second handle may be used for opening only the sub door 51. Each of the first and second handles 512 and 513 may be provided in a pocket shape that is recessed by a predetermined depth from each of the front and top surfaces of the sub door 51.

As shown in FIG. 14, a door locking part 80 may be disposed on the second handle 513 and be selectively coupled to the main door 41.

In detail, the door locking part 80 includes a grasp portion 81 corresponding to a portion that is grasped and pressed by a user's finger, an arm 82 extending from the grasp portion 81 to pass through the sub door 51 and protrude from a back surface of the sub door 51, and a hook end 83 disposed on an end of the arm 82. Also, a rotation shaft 84 may be disposed on any position of the arm 82, and the door locking part 80 may be vertically rotatably connected to the inside of the sub door 51. Also, a hook groove 148 to which the hook end 83 is inserted may be defined in a front surface of an upper portion of the main door 41, i.e., an upper edge portion of the sub box accommodation part 413.

According to the above-described structure, when the sub door 51 is closed, the hook end 83 of the door locking part 80 may be inserted and hooked to the hook groove 148. In this state, when the user pulls the first handle 512, the main door and the sub door 51 may be withdrawn together with each other. On the other hand, when the user holds the second handle 513 to press the grasp portion 81 of the door locking part 80, the arm 82 may be rotated about the rotation shaft 84 to separate the hook end 83 from the hook groove 148. In this state, when the user pulls the second handle 513, only the sub door 51 may be withdrawn forward.

Alternatively, the first handle 512 may not be separately provided, and thus the sub door 51 and the main door 41 may be selectively opened by using only the second handle 513. In detail, when it is intended to open only the sub door 51 by the user, the user may pull the sub door 51 while pressing the grasp portion 81 as described above. On the other hand, when the user opens the main door 41, the user may pull the second handle 513 in a state where the grasp portion 81 is not pressed, thereby opening the main door 41.

According to the refrigerator including the above-described constitutions, the cool air hole may be defined in the mullion that partitions the refrigerating compartment and the utility compartment. Also, the cool air hole may be selectively opened or closed by the transparent access cover. Thus, when the user opens the refrigerating compartment, a portion of the contents accommodated in the utility compartment may be confirmed.

In addition, since the access cover is opened without withdrawing the drawer provided in the utility compartment to withdraw foods accommodated in the refrigerating space of the utility compartment, the user's convenience may be improved.

Also, when the access cover is opened to utilize the utility compartment, the cool air within the utility compartment may flow into the refrigerating compartment. Thus, only a small amount of cool air may leak to the outside to reduce losses of the cool air.

Also, according to the multi drawer assembly structure in which the separate sub door is provided in the drawer shape on the drawer-type freezing compartment door, foods that are frequently taken in or out may be accommodated in the sub door to reduce losses of the cool air and improve the user's convenience.

Although implementations have been described with reference to a number of illustrative implementations thereof, it should be understood that numerous other modifications and implementations can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator, comprising:

a cabinet having:

a first storage compartment;

a second storage compartment positioned below the first storage compartment; and a third storage compartment positioned below the second storage compartment;

a first door configured to open or close a front opening of the first storage compartment;

a second door configured to open or close a front opening of the second storage compartment, the second door configured to be positioned below the first door;

a receiving box provided on a back surface of the second door and slid in the second storage compartment when the second door moves to a closed position;

a third door configured to open or close a front opening of the third storage compartment;

a mullion disposed inside the cabinet to partition the first storage compartment and the second storage compartment, and having an access hole to connect the first storage compartment and the second compartment, the access hole being formed at a front portion of the mullion to be adjacent to the front access opening of the first storage compartment and being configured to provision access to one or more food items to a user; and an access cover provided to selectively open the access hole to allow a user to take food in or out of the receiving box through the access hole in a state where the second door is in the closed position and the first door is in an opened position, the access cover having a transparent material to allow a user to see the food items in the receiving box in a state where the access opening is closed by the access cover, wherein the first compartment is controlled at a first temperature and the second compartment is controlled at a second temperature, when the first door, the second door and the access cover are closed.

2. The refrigerator of claim 1, wherein the access cover is configured to slide forward or backward to open or close the access hole, respectively.

3. The refrigerator of claim 1, wherein the access cover is configured to vertically rotate about a rear end of the access cover to open or close the access hole.

4. The refrigerator of claim 1, wherein the mullion includes a cover accommodation groove configured to receive the access cover when the access cover slidably moves in a backward direction.

5. The refrigerator of claim 1, wherein:

a top surface of the mullion includes a stepped portion configured to accommodate the access cover;

a first portion of the stepped portion directly contacts at least one storage box;

a second portion of the stepped portion that has a smaller height than the first portion of the stepped portion directly contacts a bottom surface of the access cover; and a height difference between a height of the first portion and a height of the second portion corresponds to a thickness of the access cover.

6. The refrigerator of claim 1, further comprising an additional mullion that partitions the second storage compartment from the third storage compartment.

7. The refrigerator according to claim 3, wherein a top surface of the mullion includes a stepped portion configured to accommodate the access cover.

8. The refrigerator according to claim 4, wherein the cover accommodation groove is defined under at least one storage box.

9. The refrigerator according to claim 1, wherein the second door is provided as at least two drawers which are disposed side by side.

10. The refrigerator according to claim 1, further comprising at least one storage box in the first storage compartment, wherein the at least one storage box is positioned behind the access hole.

* * * * *